United States Patent [19]

Stripling, Jr.

[11] 4,282,675

[45] Aug. 11, 1981

[54] AUTOMATIC ELEVATOR CONTROL FOR MODEL GLIDER

[76] Inventor: Sheldon A. Stripling, Jr., 1001 Esplanade Way, Apt. 41D, Casselberry, Fla. 32707

[21] Appl. No.: 58,116

[22] Filed: Jul. 16, 1979

[51] Int. Cl.[3] ..... A63H 27/14

[52] U.S. Cl. ..... 46/81; 46/76 R

[58] Field of Search ..... 46/76 R, 79, 80, 81, 46/76 A, 78

[56] References Cited

U.S. PATENT DOCUMENTS

| | | | |
|---|---|---|---|
| 1,300,564 | 4/1919 | Bliesath | 46/81 |
| 2,306,866 | 12/1942 | Crary | 46/79 |
| 2,454,598 | 11/1948 | Doyle | 46/76 R |
| 2,588,941 | 3/1952 | Stark | 46/81 |
| 2,597,521 | 5/1952 | Pemberton | 46/81 |
| 2,876,585 | 3/1959 | Zaic | 46/80 |

*Primary Examiner*—Gene Mancene
*Assistant Examiner*—Michael J. Foycik, Jr.
*Attorney, Agent, or Firm*—Macdonald J. Wiggins

[57] ABSTRACT

An automatic elevator control for improving the flight performance of power launched gliders. The elevators of a model glider are connected by a transverse axle pivoted through the fuselage, having a projecting lever arm. The lever arm is connected to an elastic band with the opposite end thereof adjustably connected to the fuselage. An upper limit stop is provided with the tension from the elastic band holding the lever arm against the stop. The elevator position is adjusted to a normal glide position for free flight when the lever arm is against the stop. During launch from a catapult or sling shot, the inertial and aerodynamic forces on the elevators overcome the tension of the elastic band causing the elevators to assume a level position. The glider can therefore be launched essentially vertically without looping and climb to a maximum altitude in a relatively straight path. As the energy from launching is dissipated, the elevator forces disappear and the elastic band returns the elevators to the glide position. A long, entertaining flight from maximum altitude is then possible.

1 Claim, 8 Drawing Figures

AUTOMATIC ELEVATOR CONTROL FOR MODEL GLIDER

BACKGROUND OF THE INVENTION

1. Field of the Invention

The present invention relates to control of model airplanes or gliders and the like, and more specifically to an automatic elevator control for improving the flight performance of model airplanes or gliders.

2. Description of the Prior Art

Non-powered model airplanes such as gliders are extremely popular. The most common type of glider airplane is designed for hand launching; however, the altitude to which the glider can be launched and the resulting flight times are relatively limited. The use of a sling shot or catapult type launcher can impart a higher initial velocity to the plane and theoretically allow a much greater altitude to be achieved before free flight would begin. However, it is necessary to slightly raise the elevators to maintain a high angle of attack in normal free-flight glide. Unfortunately, the high velocity of the launch and the resulting slip stream over the raised elevators can force the model into a looping climb generally followed by a high speed dive. At worst, the dive may carry the model into the ground with subsequent damage, or at best, the model may pull out very close to the ground which obviously limits the free flight time. These disadvantages have limited the catapult launched gliders to simple, cheaply made models with expectation of limited lifetimes.

Thus, there is a need for a sling shot or catapult launched glider type model airplane in which the elevators are set at launch to allow a straight vertical climb until the energy imparted by the launching device is dissipated and, at that point, to permit the elevators to assume a desired optimum glide position.

Control of elevators in flight have been disclosed in U.S. Pat. Nos. 3,757,462 and 3,745,699, both to Mabuchi. However, these controls operate electrically in powered models to assist in the landing phase. A manually settable elevator system is disclosed in U.S. Pat. No. 2,156,741 to Sellers and a stabilizing control is taught by Doyle, U.S. Pat. No. 2,454,598. However, none of this prior art is applicable to an automatic elevator control for power-launched gliders.

SUMMARY OF THE INVENTION

My invention is a simple, novel, and low-cost automatic control for sling shot or catapult launched model airplanes of the glider type which fills the above noted needs.

The invention is adapted to a glider having pivoted elevators, comprising elevator actuator arms attached to each elevator and pivotally mounted in the empennage. A vertically projecting lever arm is attached to the elevator actuator arm assembly such that movement of the lever arm will vary the position of the elevators. An upper limit stop is provided to stop movement of the lever at the normal position of the elevators for free-flight gliding. One end of an elastic band is coupled to the lever arm and adjustably anchored at its other end toward the forward end of the glider. By maintaining a slight tension on the elastic band, the lever arm is held against the upper limit stop during glide flight. Adjustment means is provided at the forward end of the elastic band to allow tension adjustment prior to flight.

In operation, the glider is launched essentially vertically by means of a sling shot or other type of catapult device. The sudden acceleration due to launch plus the force of the slip stream over the top surface of the elevators will force the elevators downward against the tension of the elastic band to assume an essentially straight or neutral position parallel to the longitudinal axis of the fuselage. When the slip stream across the top of the elevator just balances the back tension in the elastic band, an equilibrium position will be obtained. Due to the neutral position of the elevators, there is now no tendency for the model to nose up. The vertical trajectory will therefore be essentially straight and vertical, and will continue in this attitude until the energy imparted to the model by the launcher is overcome by gravity and air resistance. As may now be recognized, the model can obtain a high altitude before this point is reached. As the model then slows, the initial slip stream disappears, and the elastic band will then move the elevators upward against the upper limit stop. As the plane now begins to fall toward the earth, the slip stream pressure on the elevator will be insufficient to overcome the tension of the elastic band but will cause the nose to turn upward in a normal glide attitude as determined by the setting of the upper limit stop. Since the glider now begins its free flight at a high altitude and with an optimum elevator glide setting, it will normally experience a long, entertaining flight.

Advantageously, the forward end of the elastic band may be adjusted before a flight and the optimum tension experimentally determined for the particular model and launcher in use. The positive elevator control over the launch and glide phases of a model glider, in accordance with my invention, will result in much longer and more interesting flights, and a long life for the model since catastrophic crashes into the ground are essentially eliminated. Thus, it is practical and economical to build realistic scale models of actual aircraft or of fanciful designs without the danger of early destruction.

It is therefore a primary objective of my invention to provide an automatic elevator control for catapult launched gliders and the like.

It is another object of my invention to provide an automatic elevator control for gliders and the like that will cause the elevators to assume a neutral position during launching and to assume a preselected glide position when the initial launch energy is dissipated.

It is yet another object of my invention to provide an automatic elevator control for a model glider and the like which will permit high altitudes to be reached during launch and which will produce long gliding flights of the model without catastrophic dives.

It is still another object of my invention to provide an automatic elevator adjustment for model gliders and the like which adds little weight to the model, is easy to install and adjust, can be hidden inside the model, and that can be produced at a low price.

It is a further object of my invention to provide a model glider or the like having excellent long flight characteristics after power launching, and that will have a long operating lifetime.

These and others objects and advantages of the invention will be apparent from the following detailed description of the preferred embodiment when read in conjunction with the attached drawings.

DETAILED DESCRIPTION OF THE PREFERRED EMBODIMENT

Figure 1:
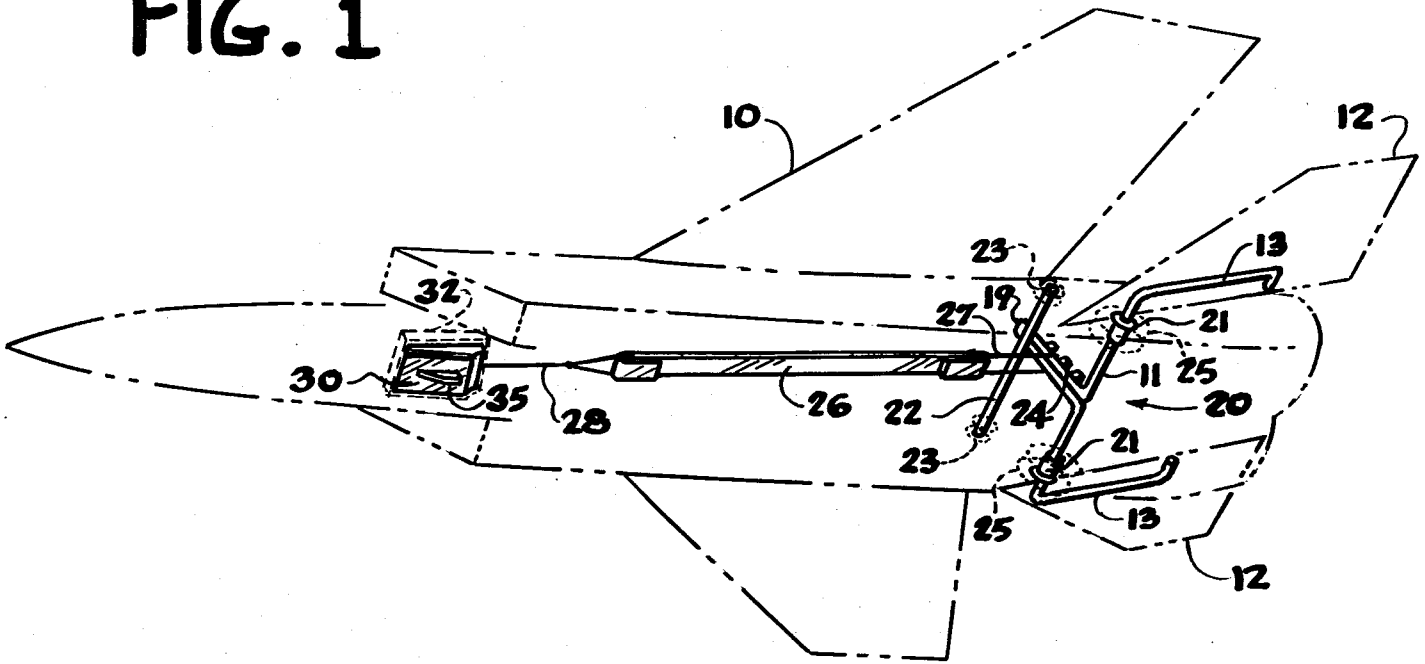
FIG. 1 is a perspective view of the automatic elevator control of my invention shown installed in a scale model glider indicated in phantom view to expose the details thereof.
Figure 3:
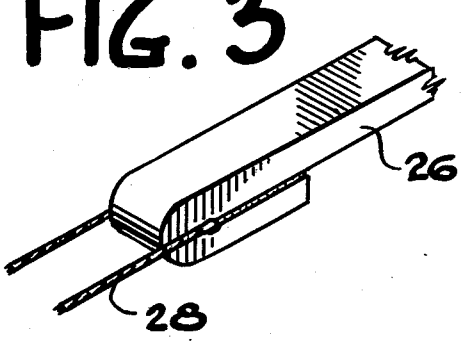
FIG. 3 is a partial view of one end of the elastic band showing a typical attachment method.
Figure 5:
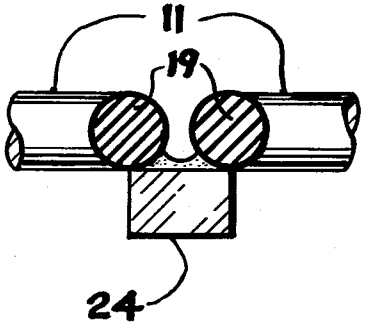
FIG. 5 is a cross-sectional view of the lever arm of the elevator control arms through plane 5-5 of FIG. 6, showing the mounting of adjustment blocks.
Figure 6:
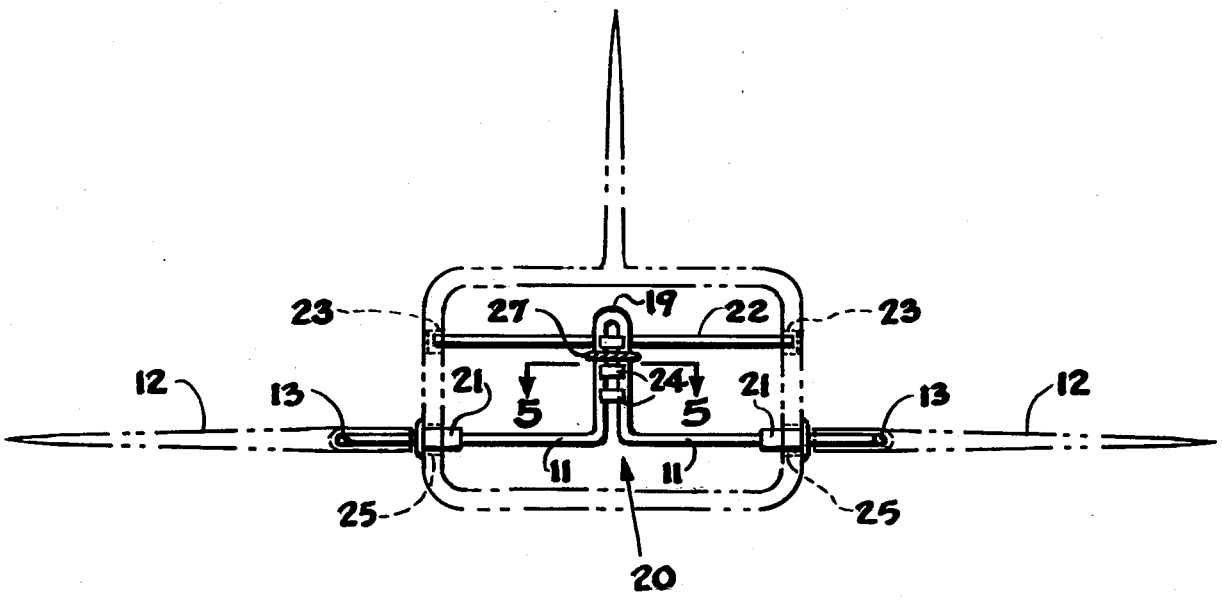
FIG. 6 is a cross-sectional view of the empennage of the model glider of FIG. 7 through the plane 6-6, showing details of the controls.

Referring to FIG. 1, a perspective view of a preferred embodiment of my invention installed in a scale model type glider 10 is shown, with glider 10 shown in phantom view to clearly disclose the invention. Elevator actuator assembly, shown generally at 20, may be formed from piano wire or similar stock and comprises a lateral axle portion 11, rearwardly extending arms 13 attached to the outer end of axle portion 11, and a lever 19 extending upwardly from axle portion 11. Axle portion 11 is pivoted in bushings 21 (which may be simple metal grommets or the like), inserted through the fuselage walls at 25. An elevator 12 is attached to each arm 13 allowing the elevators to pivot with axle 11 in bushings 21. Several small blocks 24, which may be formed from balsa wood or the like, are cemented along lever arm 19 as best seen in the cross-sectional view of arm 19 in FIG. 5. Blocks 24 form notches for attachment of yoke 27 which is formed from a cord such as thread or the like and attached to elastic band 26, which may be, for example, a thin strip of rubber. A similar yoke 28 is attached at the forward end of band 26. While various methods of connection of yokes 27 and 28 to elastic band 26 may be utilized, I prefer to use a method of attachment shown in FIG. 3. Where elastic band 26 is a strip of rubber material, yoke 28 may be attached by simply folding the end of band 26 over and cementing with an appropriate adhesive. This construction minimizes the weight of this portion of my invention. Yoke 27, as may be noted from FIG. 1 and FIG. 6, is formed from a loop of thread which is then hooked over one of the notches formed by blocks 24 on lever arm 19. As shown in the figures, the loop 27 may be placed in either of two notches, providing a control of the leverage. Where my invention is manufactured and sold to be used in a variety of airplane models having different elevator areas, a number of such notches may be provided to permit the optimum leverage to be selected for a particular model.

Figure 2:
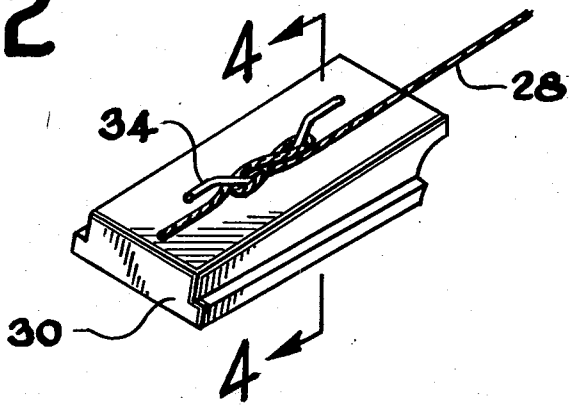
FIG. 2 is a perspective view of the forward anchoring block illustrating a method of adjustment of the elastic band.
Figure 4:
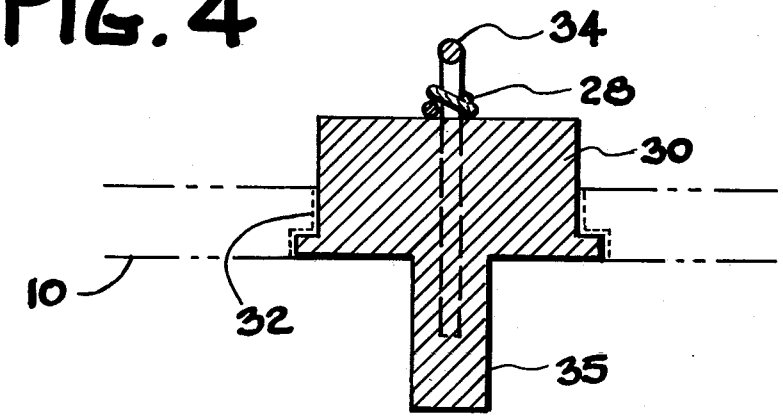
FIG. 4 is a cross-sectional view through plane 4-4 of FIG. 2 showing the anchor block installed as a hatch in a portion of the fuselage of the glider.

The forward end of elastic band 26, as mentioned above, is attached to yoke 28 which is preferably formed from thread to minimize weight. The end of yoke thread 28 is anchored on cleat 34, best seen in FIGS. 2 and 4, attached to removable hatch block 30. Hatch block 30 is formed, as seen in FIG. 4, to be inserted in an opening 32 in the forward bottom portion of the fuselage of glider 10. The tab 35 projects downward from the lower surface of hatch block 30 to permit a handhold. To make a fine adjustment of the tension in elastic band 26, hatch block 30 is removed by grasping tab 35 and pulling the hatch downward. The thread of yoke 28 is then wrapped around cleat 34, much as indicated in FIG. 2, with the point of attachment of the free end of thread 28 selected to place the desired tension on band 26. Hatch 30 is then replaced in opening 32 of the fuselage of glider 10 with the tension on elastic band 26 and a tight friction fit in opening 32 serving to hold the hatch in place. As may now be recognized, the optimum leverage for a particular model airplane may be selected by adjustment of loop 27 on lever arm 19, and a fine tension adjustment for that model plane may then be made by experimentally varying the point of attachment of thread 28 to cleat 34 during test flights. Once thread 28 is attached to cleat 34, convenient incremental adjustments may be quickly made by adding or removing loops of thread 28 around the arms of cleat 34 as may be understood with reference to FIG. 2. Tension on band 26, operative on lever arm 19, tends to move elevators 12 to an upward position. Upper limit stop 22 is installed laterally across the fuselage sides as best indicated in FIG. 6. Thus, under tension from elastic band 26, lever arm 19 is stopped from further forward movement by limit stop 22. Although I have shown a simple method of mounting a stop 22 in fuselage of glider 10, it is obvious that any type of simple stop may be used, and means provided for adjustment of the stop to suit a particular model. Where a fixed stop 22, such as indicated in FIG. 1, is utilized, the attitude of elevators 12 when lever arm 19 is against stop 22 may be easily adjusted by bending the arms of actuator arm assembly 20. Thus, the upward limit position of elevators 12 is selected to provide the desired free flight gliding characteristics of the model.

Figure 7:
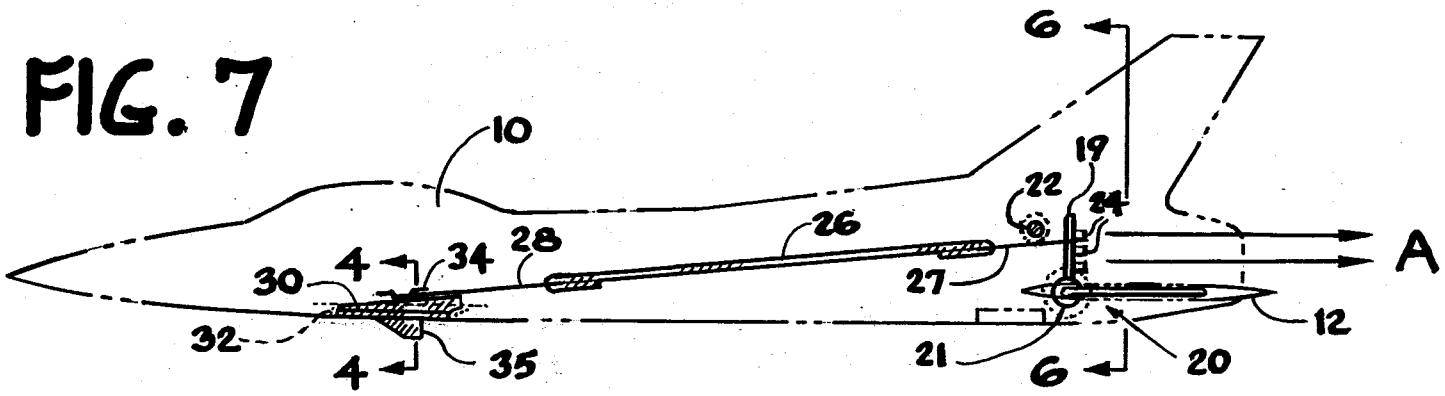
FIG. 7 is a side view of the invention installed in a typical scale model shown in phantom view, illustrating the position of the elevators during a launch phase.
Figure 8:
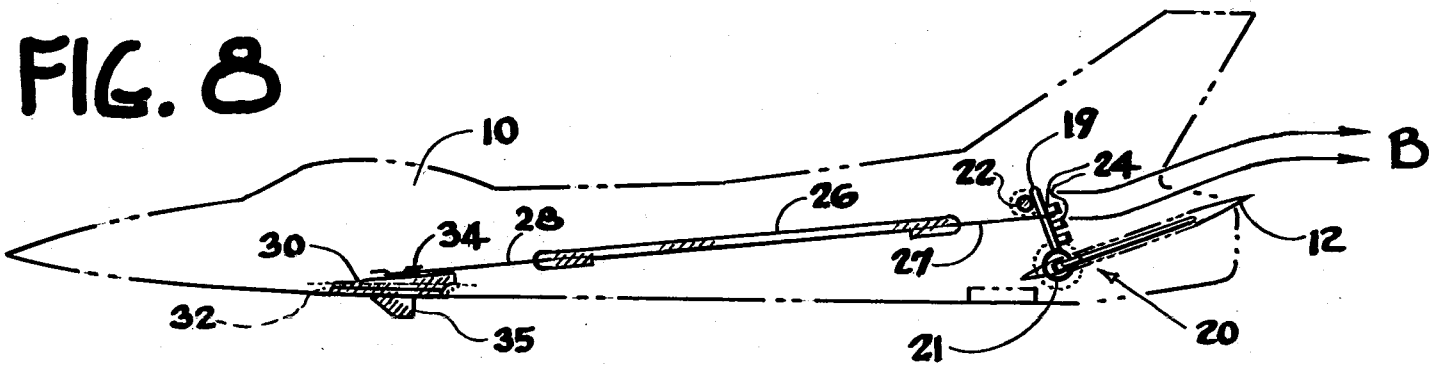
FIG. 8 is the model of FIG. 7 showing the position of the elevators during the glide phase of the flights.

Having now described the construction of the preferred embodiment of my invention, the operation of the invention will be described with reference to FIGS. 7 and 8. As may be understood, there will be two phases in the flight of glider 10. The launch phase is defined as the time from launch of the glider 10 by a sling shot, catapult, or similar launching device to the point at which the energy and inertia imparted to glider 10 by the launch is dissipated. At this point the free flight or glide phase will begin and will, of course, terminate when the plane lands on the ground. At the moment before launching, elastic band 26 will be holding lever against upper limit stop 22 with the elevators then in the normal glide position. When the glider 10 is launched by catapult, sling shot, or other powered launching device preferably in a somewhat vertical direction, the sudden acceleration of the plane 10, and more particularly the movement of air over the top surfaces of elevators 12, as indicated by flow arrows A in FIG. 7, will produce a component of pressure normal to the top surface of elevators 12 tending to push the elevators to their aligned or neutral position, shown in FIG. 7, the tension in elastic band 26 having been adjusted before launching to permit such action. Thus, during the launch phase, the aircraft control surfaces are moved to the neutral position against the momentum of the glider.

Thus, there is no tendency for the slip stream to cause curving or looping of the glider. Consequently, glider 10 will continue in an essentially straight line trajectory and will therefore achieve an altitude limited only by the initial energy and the drag on the surfaces of the model. As the vertically traveling glider 10 slows down due to drag and the force of gravity, its vertical component of velocity will eventually reduce to zero and the glider will tend to drop from gravity. Slightly before this point is reached, the force of slip stream A of FIG. 7 will have been gradually reduced to the point that the tension of elastic band 26 can overcome the pressure on the upper surfaces of elevators 12. Thus, elevators 12 will gradually return to the normal position with lever 19 against stop 22 as indicated in FIG. 8. At this point, the momentum stored in glider 10 at launch will have been dissipated and the pressure on the top surface of elevators 12 due to slip stream B will now cause glider 10 to assume a nose up attitude with respect to its line of flight. As may be recognized, this change will occur at or near the apogee of the launch trajectory as the vertical component of velocity approaches zero and the glider 10 would normally begin to fall. The aerodynamic forces now acting on the wing and elevators 12 are such as to cause the glider 10 to perform in normal free flight. Since the glider 10 starts its free flight phase at a high altitude, the conditions are ideal for a long and interesting free flight. It is obvious that the rudder, aileron and trim tab controls can be preset as well as the glide position of elevators 12 to cause the glider to perform various desired flight patterns without disastrous, near-the-ground, loops or dives. Advantageously, the capability of adjusting the tension in elastic band 26 will partially control the point in the vertical trajectory at which the elevator will be returned to its glide position and most gliders can be adjusted to provide exciting loops during ascent without the danger of hitting the ground.

The automatic control device of my invention can be supplied as a kit to be installed in various types of model airplanes, or may be furnished with a complete airplane model. By controlling the tendency of a power launched glider to loop near the ground during launch without possible destruction of the aircraft, more expensive scale model gliders of actual aircraft may be built with greatly reduced risk of early destruction or damage.

While I have disclosed above a preferred embodiment of my invention which is cheaply made and easily adjusted, it will be obvious to those of ordinary skill in the art that the invention may take on many other forms and can be adapted to a wide variety of model airplane designs without departing from the spirit or scope of my invention.

I claim:

1. Automatic elevator control device for use with a power launched scale model glider, said glider having a fuselage and a pair of elevators, comprising:

elevator adjustment means disposed within said fuselage and adapted to adjust said pair of elevators to a neutral position or to a glide position, said means attached to said fuselage;

tension means connected to said elevator position adjustment means for holding said elevators in said glide position when said glider is in free flight;

leverage adjustment means associated with said tension means and said elevator position adjustment means for permitting optimum leverage for the model glider to be selected; and tension adjustment means selectively adjustable to cause aerodynamic forces on said elevators during power launching of said glider to cause said elevators to assume said neutral position during said launching, said tension adjustment means including (a) a removable hatch block disposed in a hatch opening through said fuselage, (b) a cleat attached to an inner surface of said hatch block, and (c) a thread having a first thread end attached to said second elastic band end, and a second thread end free to be temporarily attached to said cleat so as to produce tension in said elastic band, the amount of such tension being finely adjustable by selection of the point of such temporary attachment along said second end of said thread.

* * * * *